US010397695B2

(12) United States Patent
Ovens

(10) Patent No.: US 10,397,695 B2
(45) Date of Patent: Aug. 27, 2019

(54) LAMINATED GLASS AND LAMINATED ACRYLIC LOUDSPEAKER ENCLOSURE

(71) Applicant: AUDIO KLARATY LIMITED, Hong Kong (CN)

(72) Inventor: Matthew Ovens, Revesby (AU)

(73) Assignee: AUDIO KLARATY LIMITED, Hong Kong (CN)

( * ) Notice: Subject to any disclaimer, the term of this patent is extended or adjusted under 35 U.S.C. 154(b) by 0 days.

(21) Appl. No.: 15/768,012

(22) PCT Filed: Jan. 26, 2016

(86) PCT No.: PCT/CN2016/072102
§ 371 (c)(1),
(2) Date: Apr. 13, 2018

(87) PCT Pub. No.: WO2017/063317
PCT Pub. Date: Apr. 20, 2017

(65) Prior Publication Data

US 2018/0317001 A1 Nov. 1, 2018

(30) Foreign Application Priority Data

Oct. 14, 2015 (AU) ..... 2015904204

(51) Int. Cl.
*H04R 1/02* (2006.01)
*H04R 1/28* (2006.01)

(52) U.S. Cl.
CPC ..... *H04R 1/2888* (2013.01); *H04R 1/288* (2013.01); *H04R 1/021* (2013.01); *H04R 1/2896* (2013.01)

(58) Field of Classification Search
CPC ..... H04R 1/288; H04R 1/021; H04R 1/2888; H04R 1/025; H04R 1/026; H04R 1/26; H04R 1/24; H04R 1/2826; H04R 2499/15; H04R 5/02; B23P 11/00; B29C 2948/92704; B29C 48/92
USPC ..... 181/199, 156, 144, 166, 207, 145–148; 381/335, 354, 431, 152, 182, 186, 381/301–307, 332; 29/428, 896; D14/212
See application file for complete search history.

(56) References Cited

U.S. PATENT DOCUMENTS 3,967,065 A * 6/1976 Ward ..... H04R 1/02 381/335
6,896,096 B2 * 5/2005 Nevill ..... H04R 1/26 181/148
2012/0177218 A1 * 7/2012 Yamada ..... H04R 3/02 381/89

FOREIGN PATENT DOCUMENTS

CN 2411646 Y 12/2000
CN 1299227 A 6/2001
CN 2790082 Y * 6/2006
CN 2790082 Y 6/2006
(Continued)

*Primary Examiner* — Curtis A Kuntz
*Assistant Examiner* — Julie X Dang
(74) *Attorney, Agent, or Firm* — Soroker Agmon Nordman PTE LTD

(57) ABSTRACT

A loudspeaker enclosure comprising a plurality of panels bonded together to form an enclosure for housing at least one electro-mechanical-acoustic transducer, wherein at least one of the panels comprises substantially laminated glass and at least another one of the panels comprises substantially laminated acrylic. The result is a loudspeaker enclosure that is both unique and attractive in appearance, providing very high fidelity sound reproduction.

37 Claims, 13 Drawing Sheets

(56) References Cited

FOREIGN PATENT DOCUMENTS

| | | | |
|---|---|---|---|
| FR | 2688971 | A1 | 9/1993 |
| JP | 5990205 | A | 5/1984 |
| JP | 60105398 | A | 6/1985 |
| WO | 2008155981 | A1 | 12/2008 |

* cited by examiner

LAMINATED GLASS AND LAMINATED ACRYLIC LOUDSPEAKER ENCLOSURE

BACKGROUND OF THE INVENTION

1. Field of Invention

This invention relates to the art of loudspeakers, particularly those used in high fidelity sound reproduction, and more specifically to loudspeaker enclosures which minimise panel or wall vibration, the propagation of inter-panel vibrational energy, internal sound wave reflections and modes, and resultant acoustic distortion.

2. Description of the Prior Art

Loudspeakers and a variety of loudspeaker designs have been well known since the 1940's. Over the past 70 years a great deal of work has been devoted to the design of loudspeakers. They are complex. One of the most significant aspects of loudspeaker design and construction is the enclosure itself and the potential it has for adding to, colouring and distorting the sonic output of the loudspeaker as a whole.

A loudspeaker operates by converting electrical energy into mechanical energy and then into sound wave energy in the surrounding air using one or more electro-acoustic transducers or speaker drivers. Loudspeaker enclosures, cabinets or boxes, all hereafter referred to as enclosures, are manufactured from a range of materials, most commonly wood or wood composites. They are made in a plurality of shapes and sizes.

Apart from the desired sound output coming directly from the vibrating tweeter dome(s) and midrange, midwoofer, woofer and bass woofer, all hereafter referred to as woofer cone(s), these same vibrating dome(s) and cone(s) transmit vibrational energy through their frames and mounts into the enclosure wall or panel, both hereafter referred to as a panel, which the transducer(s) are attached to. This vibrational energy, as well as sound pressure waves emitted internally from the rear of the woofer transducer(s) facing inside the enclosure, excites and propagates panel resonances throughout the enclosure which are then radiated into the surrounding air as a sonic output. This enclosure based sonic output is undesirable, introducing distortion and colouration additional to the sound produced by the transducers directly. This sonic output is somewhat delayed in relation to the transducer output as it takes time to propagate through the enclosure panels and is therefore to varying degrees out of phase with the direct transducer output causing sonic smearing. Each panel of the enclosure will therefore have its own level of phase delayed natural resonant frequency that will be emphasised rather than an even full frequency spectrum. Each resonating panel will emit sound waves 180 degrees across its surface and therefore create diffraction over the edges of the panel around its perimeter, creating additional frequency peaks and troughs of extraneous sonic output.

These loudspeaker enclosure panel resonances will also act inside the enclosure introducing additional internal sound waves and their internal reflections that will impact on the rear of the woofer transducer cones housed by the enclosure. The presence of sound waves emanating from the rear of housed woofer transducer cones facing internally are yet another source of internal sound wave activity. These sound waves are active in the air column created by the enclosure and bounce or reflect off all of the internal surfaces of the panels of the enclosure. These multiple internal sound wave reflections have a tendency to form into patterns which can create standing waves or modes. This internal sound wave activity created by internal reflections and by vibrations of enclosure panels will in turn impact in a rebounding manner against the rear of the aforementioned transducer cones, introducing an interfering and distorting sound wave energy onto these cones, adding another unwanted sonic distortion and colouration to the sonic output of the loudspeaker. All of these phenomenon reduce the clarity, accuracy or fidelity of the overall sound produced. A traditional loudspeaker enclosure with a variety of panel resonances and internal reflections will therefore produce sound that differs from that of ideally mounted transducer(s), in timing, pitch and timbre.

The ideal loudspeaker enclosure would be completely rigid and stiff, producing no resonances. The sonic output would only be emitted from the transducers themselves. The loudspeaker enclosure would secure the electro-acoustic transducers or speaker drivers, hereafter both referred to as driver(s), in their fixed positions and add nothing else to the sonic output of the loudspeaker. In reality loudspeaker enclosures are somewhat elastic structures with dynamic characteristics. At specific resonant frequencies the output from the enclosure can be as much as the direct output from the driver(s). This sound is mainly unwanted, being fundamentally unlike the output of the drivers which have a controlled response from an electrical input signal with a specific transfer function to an acoustic output.

Typically, loudspeaker enclosures are constructed by joining six flat panels, each of which exhibit resonances, depending on their respective dimensions, thicknesses, densities, layers and materials. The resonance of a panel which is excited by vibrational energy is decreased when the mass of the panel is increased. The mass of the panel is a product of the density and thickness of the panel. Therefore if either the density or thickness is increased the resonance amplitude will decrease. The resonance of a given panel can be further reduced by lamination of panel material.

When sound waves, travelling across a flat or near flat surface of a loudspeaker enclosure front panel, come to any edge of said panel, diffraction occurs which introduces unwanted ripples, peaks and troughs in the frequency response of said loudspeaker. If a transducer face plate or frame sits proud on a front panel it creates an edge and step, usually approximately 3-7 mm in height, which is sufficient to cause sound wave diffraction as the sound waves emanate outward from the dome or cone of the transducer. Diffraction of either of these kinds creates distortion of the reproduced sound.

Many companies and individuals over at least the past 50 years have engaged in the pursuit of loudspeaker design and construction with the aim of reproducing sound with increasing levels of fidelity and realism and decreasing levels of distortion and colouration, often referred to as high-fidelity loudspeakers. The minimisation of enclosure resonances in a given loudspeaker is a critical feature in the design and manufacture of high fidelity loudspeakers.

There have been a number of measures taken by manufacturers in order to try to defeat or control these loudspeaker enclosure resonances. Some have lined the internal panels of loudspeakers with dense materials such as bitumen. Some have built simple or complex internal bracing structures attached to the panels of the enclosure in order to stiffen them. Others have made the front panel of the loudspeaker enclosure from very dense and or thick materials. In more recent years manufacturers have designed loudspeaker enclosures with curved panels to reduce resonances. Each of these approaches have their own manufacturing issues and limitations. They have only been partially effective in mitigating the resonant interference produced by loudspeaker enclosures and have added to the overall complexity and cost of production.

The problem of inter-panel propagation of vibrational energy is typically not addressed in the manufacture of traditional loudspeakers, often made of wood. Enclosure panels are usually glued and or screwed together rigidly which allows virtually unhindered transmission of vibrational energy between adjoining panels.

Manufacturers typically try to reduce the effect of internal sound waves and reflections by lining and/or stuffing loudspeaker enclosures with synthetic or natural fibres, foams or padding materials. In the embodiments of this novel loudspeaker enclosure such internal materials would have a poor aesthetic appearance and obstruct the internal view afforded by the use of laminated glass. These issues are addressed in the embodiments by the use of carefully chosen, prepared and positioned internal perforated foam and acrylic baffles that act to diffuse and dampen said sound waves and reflections with a minimum of obstruction to views through the glass panels and in an aesthetically interesting and pleasing way.

Some prior art loudspeaker arrangements are known in which loudspeaker enclosures are constructed from glass panels. However they are manufactured from specially produced non-laminated proprietary glass. This type of glass involves complex manufacturing processes and/or significant additional expense. In another known loudspeaker arrangement, enclosures have been constructed from thinner glass panels which do not adequately dampen panel resonances and result in various extraneous vibrational energy sonic emissions and/or 'ringing'.

In another know loudspeaker arrangement monolithic toughened glass panels are used to construct loudspeaker enclosures. Toughened glass is not as effective acoustically in terms of its resonant qualities. Toughened glass is harder and stronger than laminated glass but is not well damped and produces noticeable resonant activity when excited, resulting in a 'ringing' sound output. Monolithic toughened glass also shatters and collapses when broken.

In yet another known loudspeaker arrangement, thin laminated glass is used as a transducer itself, excited by an electromechanical activator at its base. The laminated glass 'wing', vertical in its orientation, having a total thickness of approximately 3 mm, is held in position only at its base. It is not an enclosure to house transducers, it is a transducer, without an air cavity enclosure. Unlike the present invention it utilises thin laminated glass specifically designed to vibrate and emit sound waves, producing the acoustic output.

SUMMARY OF THE INVENTION

It is therefore an object of the present invention to provide a loudspeaker enclosure comprising a plurality of panels bonded together to form an enclosure for housing an electroacoustic transducer, wherein at least one of the panels comprises substantially laminated glass and another one of the panels comprises substantially laminated acrylic.

Preferably, the front panel comprises substantially laminated glass.

Preferably, the front panel is partially covered by the laminated acrylic front panel.

Preferably, the front panel comprises substantially laminated acrylic.

Preferably, the panel with the greatest surface area comprises substantially laminated glass.

Preferably, the top panel and the two side panels comprise substantially laminated glass.

Preferably, the top panel and side panels comprise substantially laminated glass.

Preferably, enclosure side panels comprise substantially curved laminated glass.

Preferably, enclosure panels comprise substantially laminated acrylic.

Preferably, the loudspeaker enclosure panels comprise laminated glass made of lites of glass of unequal thickness.

Preferably, the loudspeaker enclosure panels comprise laminated glass made of two or more layers of glass lites.

Preferably, the laminated glass panels are made using EVA interlay material.

Preferably, the loudspeaker enclosure panels comprise laminated acrylic made of sheets of acrylic of unequal thickness.

Preferably, each of the panels comprises arrised edges.

Preferably, at least one panel is bonded with another panel using semi-flexible vibrational energy absorbing material.

Preferably, the semi-flexible vibrational energy absorbing material comprises silicone or acrylic adhesive.

Preferably, the panels form a substantially cube-like or rectangular cube-like enclosure.

Preferably, the loudspeaker enclosure further comprises a front laminated glass panel having an aperture for receiving a woofer transducer unit, wherein the woofer transducer unit is connected to the laminated glass panel by a mounting ring, the mounting ring is bonded to the laminated glass panel by semi-flexible vibration absorbing material, and the mounting ring of the woofer transducer unit comprises a perimeter edge tapering down outwardly to partially cover a front surface of the laminated glass panel.

Preferably, the mounting ring comprises substantially a non-resonant dense engineering plastic material such as acetal or ABS/acrylonitrile butadiene styrene.

Preferably, the woofer unit comprises a mounting ring made of engineering plastic and a woofer transducer, wherein the mounting ring fits into the aperture on the laminated glass panel.

Preferably, the mounting ring comprises a tapering circumferential fringe sitting on the front surface of the laminated glass panel, such that the outer edge of the woofer transducer and the mounting ring forms a gradual slope to the front surface of the panel to form a non-refracting perimeter mounting edge.

Preferably, the tweeter transducer unit comprises a tweeter transducer connected to a waveguide which fits into an aperture in the laminated glass panel, wherein the waveguide comprises an outer edge extending outwardly from the tweeter transducer over the front surface of the laminate glass panel, such that the outer edge of the waveguide tapers down to cover partially a front surface of the laminated glass panel with a gradually sloping surface.

The waveguide and laminated glass panel being connected together by semi-flexible vibrational absorbing material.

Preferably, the waveguide comprising substantially of a non-resonant dense engineering plastic material, such as acetal or ABS.

Preferably, the loudspeaker comprises a laminated glass panel having an aperture for receiving a tweeter transducer unit comprising a modified face plate which covers the said aperture and is bonded to the laminated glass panel with semi-flexible vibrational absorbing material. The modified face plate being substantially of engineering plastic or metal alloy material and having a perimeter edge tapering down outwardly to the surface of the laminated glass.

Preferably, the loudspeaker enclosure comprises a laminated acrylic partial front panel bonded on top of a front panel of laminated glass with semi-flexible vibrational energy absorbing material, wherein the laminated acrylic front panel and the laminated glass front panel, each of which has at least one aperture coincided with one another for receiving the at least one tweeter and/or woofer transducer(s), such that a front surface of the tweeter and woofer transducers and a front surface of the acrylic partial front panel are flush with one another to form a coplanar surface.

Preferably, the laminated glass front panel is partially covered by the laminated acrylic front panel.

Preferably, the loudspeaker enclosure comprises a laminated acrylic front panel bonded to at least one laminated glass top, bottom or side panel(s) front edge(s) with semi-flexible vibrational energy absorbing material, having at least one aperture for receiving at least one speaker driver transducer, such that a front surface of the transducer and a front surface of the laminated acrylic front panel are flush with one another to form a coplanar surface.

Preferably, the loudspeaker enclosure further comprises at least two foam sheet baffles disposed inside of the loudspeaker enclosure with at least one of the foam sheets positioned obliquely across two of the three internal dimensions and another across the remaining dimension of the internal enclosure space, wherein each foam sheet is perforated with a plurality of holes of between 5-25 mm in diameter occupying a total of approximately 20-45% of their surface area.

Preferably, each foam sheet has a density between 25-35 $kg/m^3$, a hardness of between 200-400 Newtons, and a thickness of between 1-4 cm's.

Preferably, the loudspeaker enclosure comprises an acrylic baffle fixed internally in the loudspeaker enclosure, wherein this sound wave disrupter and diffuser comprises at least one perforated clear acrylic panel or hollow tube or hollow sphere or hollow half sphere with a thickness of between 2-4.5 millimeters, which comprises dimensions not less than 30% of the smallest internal dimension and not more than 90% of the largest internal dimension of the loudspeaker enclosure with at least one perforated clear acrylic panel or hollow tube or hollow sphere or hollow half sphere are perforated with a plurality of holes of between 5-35 mm in diameter comprising a total of approximately 20-55% of their surface area.

Preferably, the foam sheet and acrylic panel or hollow tube or hollow sphere as described are not perforated.

Preferably, the thickness of one or more panels of laminated glass is between 6-18 millimeters.

Preferably, the thickness of the at least one panel of laminated glass comprises one glass lite of between 3-8 millimeters laminated to another glass lite of unequal thickness of between 3-8 millimeters.

Preferably, the thickness of the interlayer of one or more panels of laminated glass is between 0.3-0.9 millimeters.

Preferably, the thickness of the at least one panel of laminated acrylic comprises one acrylic panel of between 3-10 millimeters laminated to another acrylic panel of unequal thickness of between 10-20 millimeters.

Preferably, the thickness of the double sided self-adhesive interlayer of one or more panels of laminated acrylic is between 0.3-0.7 millimeters.

Preferably, the loudspeaker further comprises an internal light source such that the internal light source is visible through the laminated glass panel.

The present embodiments provide loudspeaker enclosure arrangements that reduce enclosure resonances through the novel use of laminated glass panels, laminated acrylic panels and engineering plastic acetal or ABS transducer mounts, bonded to the front panel of said loudspeaker enclosure.

It is an object of one embodiment to provide a laminated glass loudspeaker enclosure that also reduces the propagation of vibrational energy from said laminated panels to their adjacent panels through the use of a thin layer of energy absorbing firm but flexible clear adhesive silicone or clear pressure sensitive double sided adhesive acrylic tape acting as the inter-panel joint bonding material providing a vibrational energy decoupling effect.

It is another object of one of the embodiments to provide a laminated glass loudspeaker enclosure that includes a range of preferred materials and methods of fastening the chosen transducers to the front panel of the loudspeaker enclosure or cabinet. The transducers are fastened to circular acetal or ABS mounting rings which are bonded to the front panel of the enclosure with silicone or adhesive acrylic tape, both of which provide an additional medium for decoupling, absorption and reduction of vibrational energy while also being aesthetically pleasing. These acetal or ABS mounts are tapered down to the surface of the panel at their perimeter which also aids in the reduction of diffraction as sound waves travel from the centre of the speaker driver transducers out over the edges of the transducer perimeter frame and over the mounting rings.

It is yet another object of one of the embodiments to provide a laminated glass loudspeaker enclosure that contains internal baffles made of foam sheets, and clear acrylic sheets, hollow spheres, tubes, half spheres or half tubes. These baffles are glued to the base and/or rear of the enclosure or to each other so as to sit parallel to an enclosure panel or at oblique angles to enclosure panels, thereby diffusing and damping internal sound waves and their reflections, therefore disrupting and reducing the development of internal standing waves or modes in the internal air column of the enclosure.

In one of the embodiments, there is provided for, the construction of loudspeaker enclosures made of laminated glass and laminated acrylic of various thicknesses with resonance damping properties that would require significantly thicker non-laminated glass or acrylic to achieve similar resonance damping results.

It is another object of one of the embodiments to provide a loudspeaker enclosure that is made from readily commercially available and relatively less expensive laminated glass and laminated acrylic, compared to some already known loudspeaker arrangements using expensive proprietary materials.

One of the embodiments provides for the use of laminated glass and laminated acrylic for the construction of loudspeaker enclosures which, once the material has been cut, and the edges have been ground and polished with arrised finish, the result is a very aesthetically pleasing and attractive appearance that does not require a frame or scaffold internally or externally nor any further finishing such as staining, varnishing, painting or veneering, typically necessary for wooden enclosures.

One of the embodiments further provides for a plurality of aesthetic effects, achieved by choosing laminated glass with clear or variously tinted interlays, or acrylic sheet available in a range of colours.

Another embodiment relates to a variety of loudspeaker systems including but not limited to bass reflex, sealed box, aperiodic or dipole designs.

Yet another preferred embodiment relates to a range of loudspeaker designs including those with a plurality of transducers and including but not limited to bookshelf or standmount loudspeakers, audio-visual centre & surround speakers, floorstanding or tower loudspeakers and sub-woofer loudspeakers.

Another embodiment of the present invention provides a method for use of laminated glass and laminated acrylic for the construction of loudspeaker enclosures as described which has resulted in the initial audio assessment of an enhanced acoustic output. In an A-B comparison of bookshelf loudspeakers, one made of standard commercial 10.38 mm laminated glass, 15+3 mm laminated acrylic and acetal transducer mounts and the other made of 25 mm MDF with standard mounting directly into the MDF, the enclosure being of similar dimensions using the same drivers and crossover network, the laminated loudspeaker produced a noticeable subjective improvement in acoustic quality, being more uncoloured, undistorted, clear, transparent and lifelike.

BRIEF DESCRIPTION OF THE DRAWINGS

The various features and advantages of the present invention will become more clearly appreciated as a description is made with reference to the appended drawings. In the drawings.

DETAILED DESCRIPTION OF THE INVENTION

Preferred embodiments of the present invention will be described below by making reference to FIGS. 1 to 19 of the drawings.

The present invention was developed for use in a high performance high fidelity audio system.

Laminated glass was invented in 1903 by the French chemist Edouard Benedictus. It was widely used in the eyepieces of gas masks during World War I. After the war it became increasingly used by automobile manufacturers for windscreens. Early versions of laminated glass often used cured resin as the interlay material.

Figure 1:
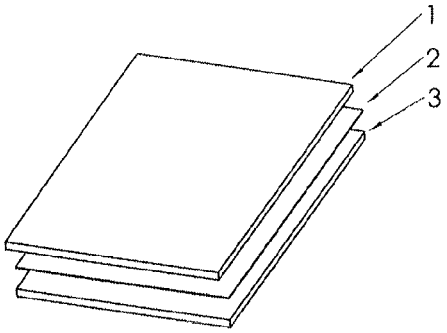
FIG. 1 is a perspective view of the three typical layers in laminated glass.

Modern laminated glass, as illustrated in FIG. 1 is typically produced by bonding two or more layers of float or annealed glass 1 & 3 together with an interlayer 2, typically polyvinyl butyral (PVB) or ethylene vinyl acetate (EVA) copolymer thermoplastics. The interlayer is sandwiched between glass lites of equal or unequal thickness which are passed through rollers to expel any air pockets to form an initial bond, which is then completed under specified heat and pressure. The interlayer can be clear or tinted in a plurality of colours. There are other less common interlay materials sometimes used to laminate glass including thermoplastic polyurethane (TPU), 'cast in place' (CIP) resins and very tough lonoplast polymers.

Laminated glass is very well known and often utilised by the glass and glazing industry in Australia and internationally. It is often chosen for its enhanced safety and security properties. It is safer than standard float glass monolithic panes because the glass is strongly bonded to the interlayer material and in the event of breaking, even though it may develop many cracks, it tends to hold together rather than breaking up into pieces of sharp and potentially dangerous shards of glass. It is therefore more secure than float glass as the interlayer material although thin is strong and resists puncturing.

Figure 2:
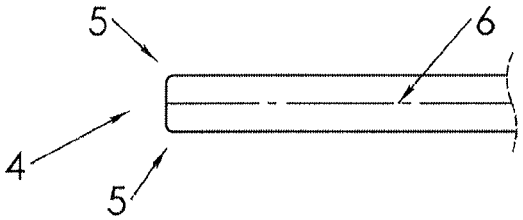
FIG. 2 is a cross section view of a partial panel of laminated glass.

PVB and EVA interlays 6 as shown in FIG. 2 are available in a range of thicknesses typically 0.38 mm, 0.76 mm or 1.52 mm although it can also be of other thicknesses, sometimes a few millimeters or more in thickness for large industrial applications. More than one layer of interlay may be used in order to create a desired thickness of laminate, for example two 0.38 mm sheets bonded together form 0.76 mm, two 0.76 mm sheets bonded together form 1.52 mm, and two 1.52 mm sheets bonded together form 3.04 mm. The glass lites and interlayer are strongly bonded together in controlled conditions typically using the process as briefly described above of a specified heat and pressure applied for a specified period of time.

Laminated glass may also consist of panels of heat strengthened or toughened glass bonded together with an interlay material. Some manufacturers of glass, for the purpose of sound insulation in buildings, produce laminated glass using a specific acoustic interlayer, for example VLam Hush™ made in Australia by Viridian. These purpose made interlays have enhanced sound transmission damping qualities. As described above modern laminated glass can be made using a variety of thermoplastic interlay materials. Laminated glass can be made from glass sheets or lites of two different thicknesses, for example 4 mm glass lite, interlay, 6 mm glass lite. This enhances the damping qualities of the finished laminated glass as the two unequal thicknesses of glass lites will each have different natural resonant frequencies and therefore together will not combine at one common resonant frequency. Laminated glass can also be made in curved or bent shapes, typically for specific architectural applications. Laminated glass can be made from three or more layers of glass with interlay between each pair of adjacent glass lites. All of these various types of laminated glass with a variety of interlayer material can be utilised to construct loudspeaker enclosures and are within the scope of this invention.

The foundations for the development of plastics began in the mid to late 19th Century via the industrial revolution and the advent of organic chemistry. Polymethyl methacrylate (PMMA) commonly known as acrylic became available as a manufacturing material in the early 20th Century. Engineering thermoplastics such as polyoxymethylene (POM) commonly known as acetal and acrylonitrile butadiene styrene (ABS) became available in the mid 20th Century. Acrylic, acetal and ABS are approximately twice the density of medium density fibreboard (MDF) sometimes referred to as custom wood, which is often used in standard loudspeaker enclosure manufacturing. Acetal has excellent properties including strength and stability and is a relatively non resonant material compared to many other modern plastics. It is not brittle and has excellent internal damping properties. It is very suitable for either industrial machining or injection moulding. ABS is also an excellent engineering plastic choice for injection moulding. Acrylic can easily be laminated to itself in layers with the use of thin double sided self-adhesive industrial sheeting.

The use of laminated glass and laminated acrylic attenuates enclosure panel resonances because of the inherent damping and strengthening effect of the three layer 'sandwich', ie: material—interlay—material. With laminated glass the interlayer acts as an energy absorbing material and a decoupler between the two lites of glass. With laminated acrylic the double-sided adhesive sheet acts as an energy absorbing layer and decoupler of the two sheets of acrylic. Using two unequal thicknesses of glass lite or acrylic sheet in the laminating process further reduces resonance. These result in a considerably more acoustically dampened or non-resonant quality compared to standard single pane float or annealed glass and single sheet acrylic of similar thickness and dimensions. These laminated materials also have a more even attenuation of the amplitude of vibrations and resonances across the audible frequency spectrum compared to normal single layer panels of similar thickness and dimensions. Non laminated monolithic panels of glass and acrylic tend to have more frequency response peaks in the audible frequency spectrum. For example, monolithic float glass of 8 mm thickness has a resonance peak of approximately 7 dB at around 2000 Hz. Laminated glass with a total thickness of 10 mm has no peak at all in the critical 500 Hz to 4,000 Hz frequency range. (EN 12758; sourced by Pilkington UK, European Technical Centre, Lathom, Lancashire—"Optiphon" technical brochure, 8222, June 2014).

Glass is a dense material approximately three and a half times the density of typical MDF which is commonly used in loudspeaker enclosure construction. Acetal has a density of approximately twice that of typical MDF. The approximate densities of the various relevant materials referred to in this specification are as follows: MDF 0.6-0.8 g/cm$^3$, ABS 1.0-1.2 g/cm$^3$, Acrylic 1.1-1.3 g/cm$^3$, Acetal 1.4-1.6 g/cm$^3$ & Glass 2.4-2.6 g/cm$^3$.

The use of high density materials aids in resonance damping, as a heavier panel resonates with less amplitude compared to a less heavy panel in the presence of the same level of vibrational activating energy. A material that is very hard can be high in resonant activity. A material that is dense and thick is likely to be low in resonance. Toughened or heat strengthened glass is harder and stronger than standard annealed float glass, however standard laminated glass is far superior to toughened or heat strengthened monolithic glass of similar overall thickness in its inherent resonance damping qualities.

The laminated glass used in the preferred embodiments is typically though not limited to grey tinted laminated glass, which is typically though not limited to commercially available laminated glass consisting of two glass lites of unequal thickness of between 3 mm-8 mm each. Thinner or thicker laminated glass can be used within the scope of this invention. The laminated acrylic used in the preferred embodiments is typically though not limited to solid black, and the two layers of acrylic are of unequal thicknesses, one being typically between 3-10 mm in thickness and the other being typically between 10-20 mm in thickness. As described above this has the added advantage of having two different natural resonant frequencies which therefore do not combine with each other.

In striving for a balance between acoustics and aesthetics an interlayer of between 0.38 mm and 0.76 mm is preferred. A thickness of less than 0.38 mm is considered to be inadequate for the level of acoustic damping desired and a thickness of greater than 0.76 mm is considered to be unacceptable aesthetically in the embodiments. The double-sided self-adhesive industrial sheeting used to laminate the acrylic panels is typically about half a millimeter in thickness and provides a very strong long term bond with some flexibility and excellent damping.

In the preferred constructions of loudspeaker enclosures, laminated glass panel edges are exposed, and may be affected by air, humidity and joint bonding adhesives. PVB interlay tends to be somewhat hydrophilic and over time the thin layer of PVB that is exposed along a polished edge can develop edge defects that are visible. EVA interlay tends to be somewhat hydrophobic and less susceptible to edge defects over time along exposed edges in the presence of humidity. It is also less likely to be affected by moisture in silicone adhesive in panel butt joints. It is therefore advantageous that the loudspeaker enclosure embodiments are constructed from laminated glass made with EVA interlay.

Laminated glass and acrylic can be cut by hand or cut utilising purpose built and automated machinery. Polished perimeters 4 and arrised edges 5 as illustrated in FIG. 2 can be produced utilising straight edge polishing machines with glass, and polishing pads and/or flaming with acrylic.

Figure 3:
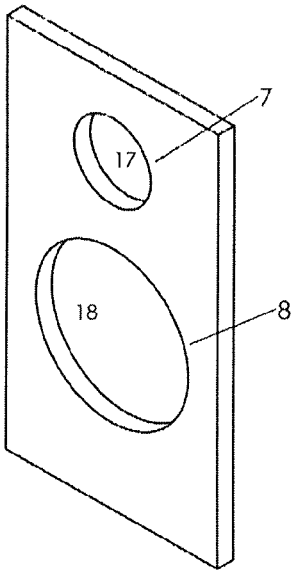
FIG. 3 is a perspective view of laminated glass front panel of a bookshelf loudspeaker with insertion mounting holes for a tweeter and a woofer.

Holes 7 & 8 in a front laminated glass or laminated acrylic panel as shown in FIG. 3 are required to fit transducers and are typically cut using commercially available water-jet cutting machines for glass and industrial routers for acrylic. Additional holes or cut-outs are typically required in the rear panel of the loudspeaker enclosure for inserting acoustic reflex ports, for affixing speaker cable connectors and other access holes to the enclosure interior as may be required according to the loudspeaker design.

Figure 4:
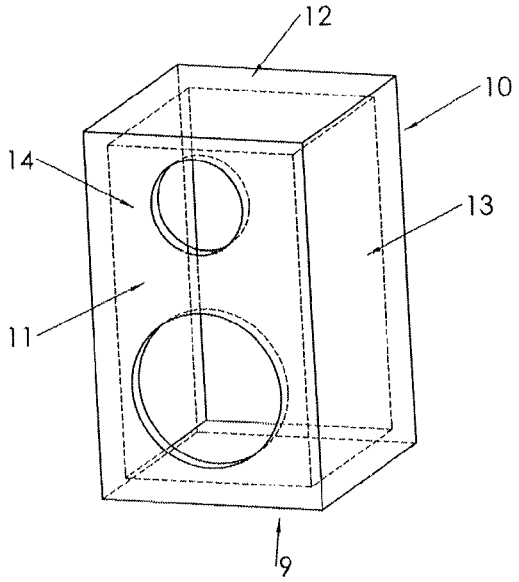
FIG. 4 is a perspective view of a simplified laminated glass bookshelf loudspeaker enclosure.
Figure 5:
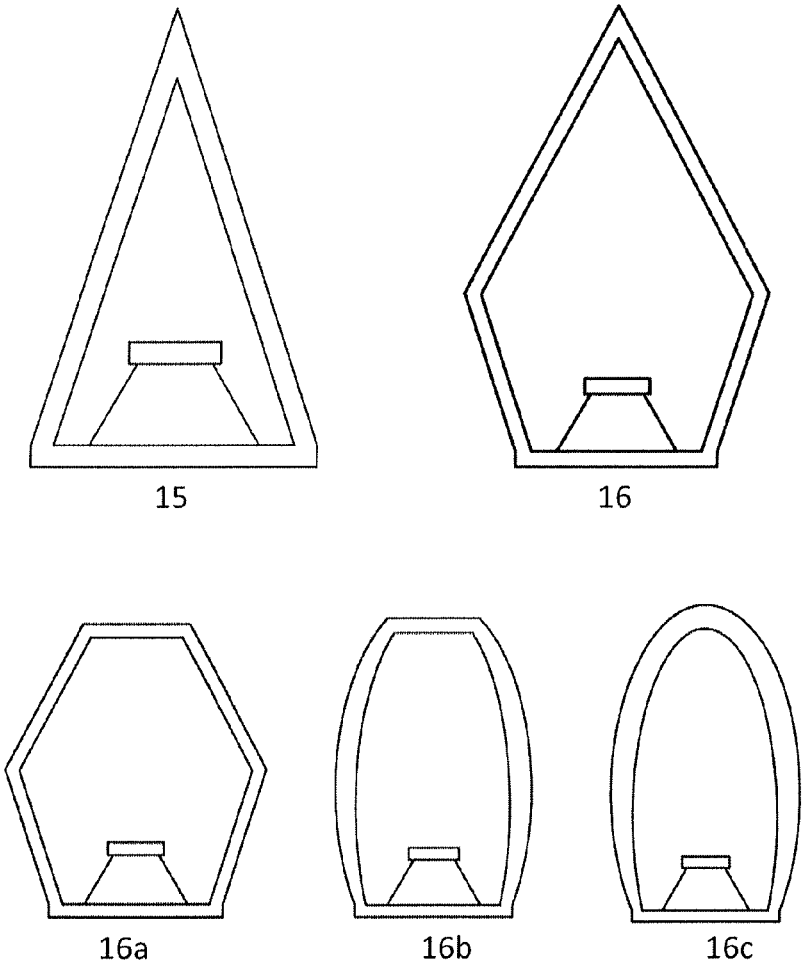
FIG. 5 is a top view of different enclosure design options.

The embodiment of a bookshelf laminated glass and laminated acrylic loudspeaker enclosure has a plurality of panels, typically though not limited to a six sided rectangular cube as shown in FIG. 4. In a rectangular cube in order to realise the maximum benefits of the damping effects of laminated glass and laminated acrylic and maintain the objective of being able to view the inside of the enclosure and provide an appealing and attractive aesthetic, the preferred enclosure consists of between three and five panels of laminated glass and of between one and three panels of laminated acrylic. The range of preferred embodiments for the laminated glass and acrylic rectangular cube enclosure are as follows: one panel, namely the bottom 9 or rear 10 panel is laminated acrylic; two panels, namely the rear 10 and bottom 9, or front 11 and rear 10 panels are laminated acrylic; three panels, namely the rear 10, bottom 9 and front 11 panels are laminated acrylic. In all embodiments at least the top 12 and both side panels 13 & 14 are laminated glass. Both side panels 13 & 14 typically being the panels with the greatest surface area in a loudspeaker enclosure configuration and therefore the most susceptible to resonant activity provide the damping benefits and internal view afforded by the use of laminated glass.

These laminated glass and laminated acrylic loudspeaker enclosures can include designs other than six sided rectangular cubes. Enclosure embodiments can also be constructed with five panels 15 or seven 16 or eight 16*a* or more panels of laminated glass and laminated acrylic, or with curved laminated panels 16*b*, 16*c* as shown in views of the top of the enclosures in FIG. 5.

Figure 6:
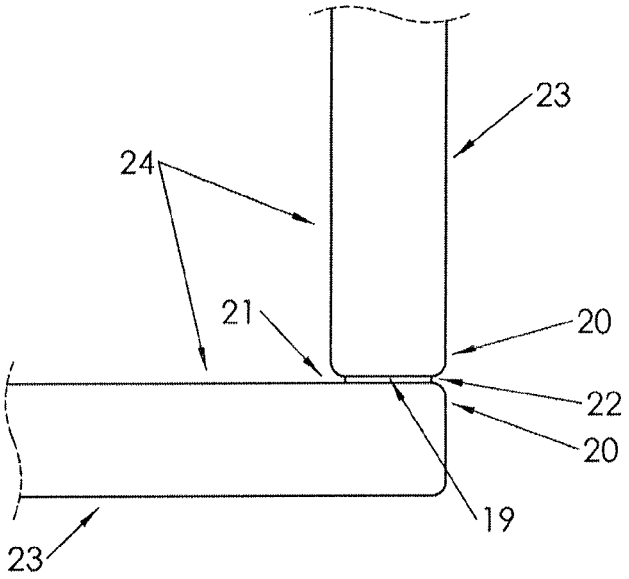
FIG. 6 is a cross-sectional view of a butt joint of two partial panels of laminated glass.
Figure 7:
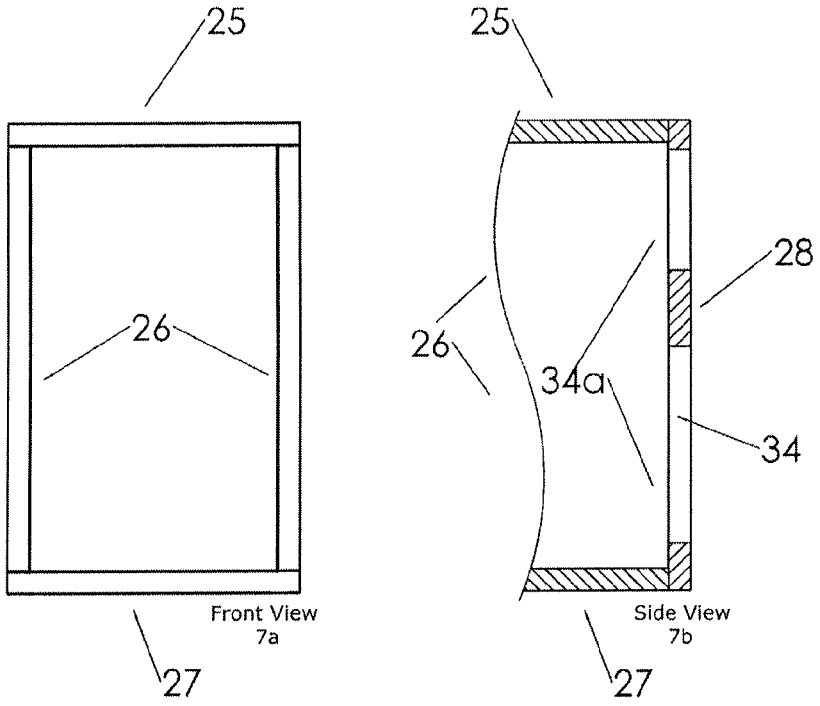
FIG. 7 is a simplified front & partial side view of a laminated glass loudspeaker enclosure.
Figure 8:
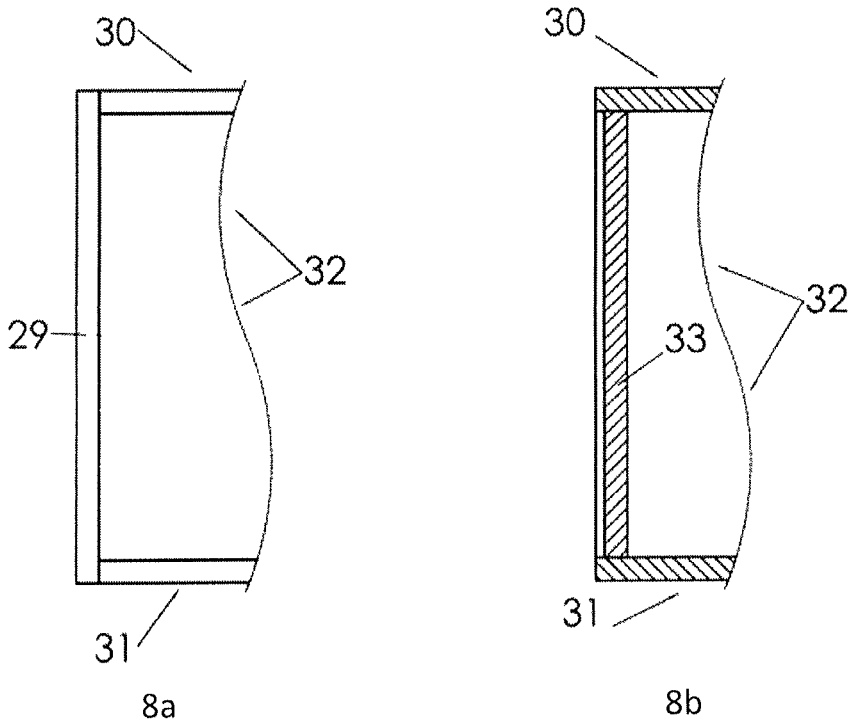
FIG. 8 is a simplified partial side view of two preferred embodiments of a laminated glass loudspeaker enclosure.

In the construction of the preferred embodiments, laminated glass panels and laminated acrylic panels are carefully measured, cut and polished smooth with an arrised finish to all edges. The arrised finish removes sharp edges that may otherwise present a cutting injury risk during handling. The panels requiring holes to fit drivers or other required parts then have those holes (for example FIGS. 3, 17 & 18) cut accordingly, as illustrated in FIG. 3. The panels are then bonded together in the appropriate configuration and sequence, using typically approximately half to one millimeter thickness of a clear semi-flexible adhesive sealant compound, silicone, polymer, copolymer or pressure sensitive double-sided clear industrial strength acrylic adhesive tape 19 as shown in FIG. 6. The preferred semi-flexible adhesive sealant being either clear non-acidic neutral cure silicone or clear industrial acrylic adhesive tape. The joints between the panels are typically butt joints 20 although they can be mitred or other joint types. Once the adhesive material has dried, set or fully bonded any excess material that is showing beyond the immediate confines of inter-panel joints is removed from both the interior and exterior of the enclosure, including all the internal 21 and external 22 exposed arrised surfaces. The acetal or ABS transducer mounts are adhered with semi-flexible adhesive sealant or pressure sensitive tape to the front panel. This provides an extra layer of vibrational energy absorption material between the transducers fastened to the mounts and the loudspeaker enclosure panel as described, further reducing the propagation of resonances originating from the transducers. In typical loudspeaker cabinet construction using MDF panels this additional damping is not present as the transducers are typically screwed directly into the front MDF panel, which results in the propagation of vibrational energy into all the enclosure panels.

In the construction of the enclosures of the preferred embodiments as shown in FIG. 7*a* the top panel 25 sits horizontally on top of and covers the top edges of both vertical side panels 26. The whole front panel 28 in FIG. 7*b* sits in front of and covers all the front or forward facing edges of the top 25, bottom 27 and side 26 panels.

There are two preferred construction configurations of the rear panel of the enclosures. In the first case the whole of the rear panel 29 sits behind and covers all the rear or back edges of the top 30, bottom 31 & side 32 panels, as shown in FIG. 8*a*. In the other case the rear panel 33 sits indented 1-3 mm in behind the back or rear edges of the top 30, bottom 31 and side 32 panels, as shown in FIG. 8*b*.

The preferred loudspeaker enclosure embodiments use a variety of driver mounting arrangements which will now be described. In all of the following described constructions the layer of vibrational energy absorbing and decoupling adhesive sealant is either semi-flexible clear neutral cure silicone or semi-flexible double sided pressure sensitive industrial strength clear acrylic tape, both being approximately half to one millimeter in thickness.

In order to optimise the acoustic fidelity of the loudspeaker it is important to minimise diffraction occurring at the perimeter circumference edge of woofers and tweeters that are fastened to the loudspeaker enclosure. The use of laminated glass front panels introduces challenges in achieving this as it is impractical to rebate glass panels.

Figure 9:
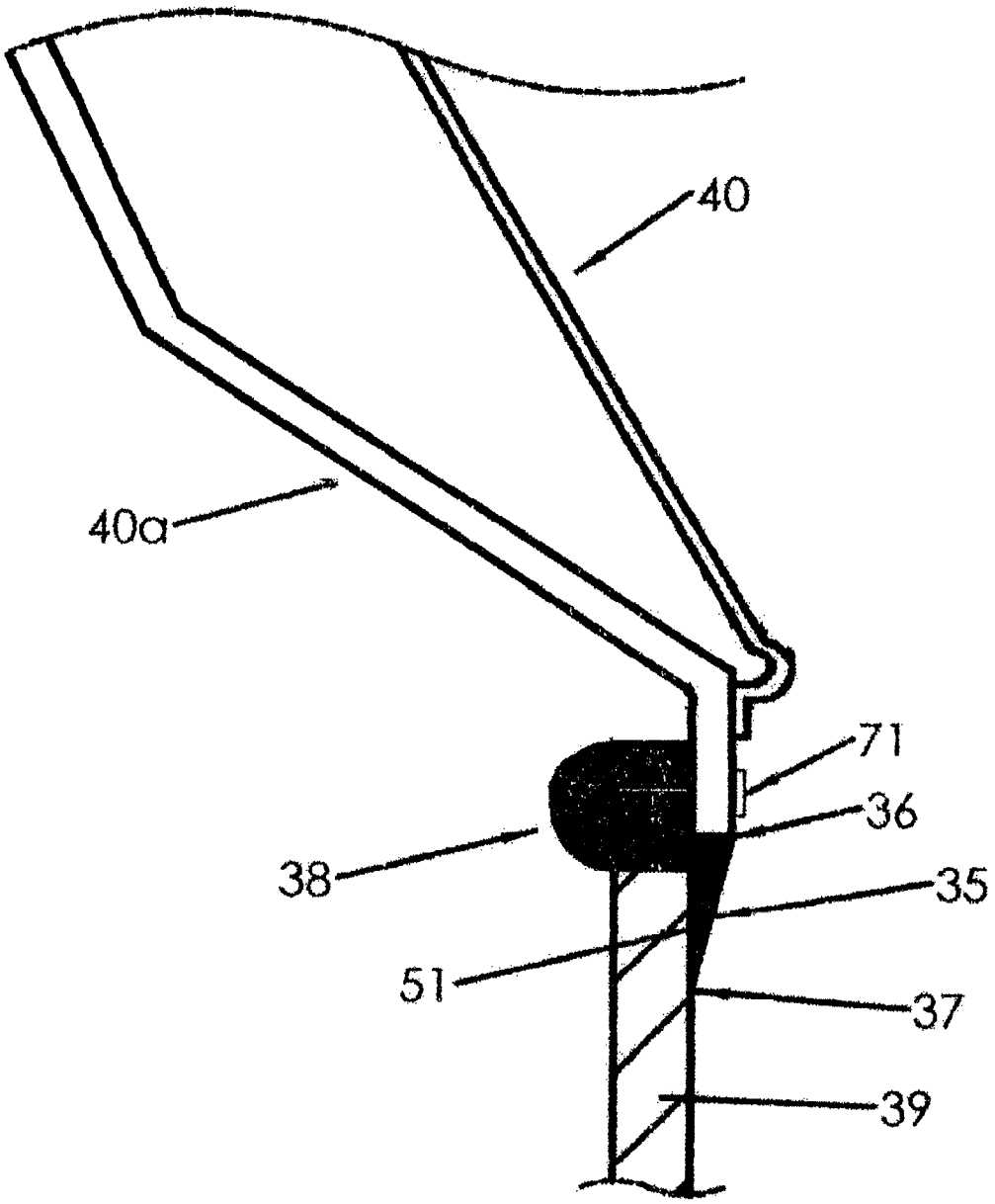
FIG. 9 is a partial close up cross section side view of a preferred woofer transducer, mount and front panel.
Figure 10:
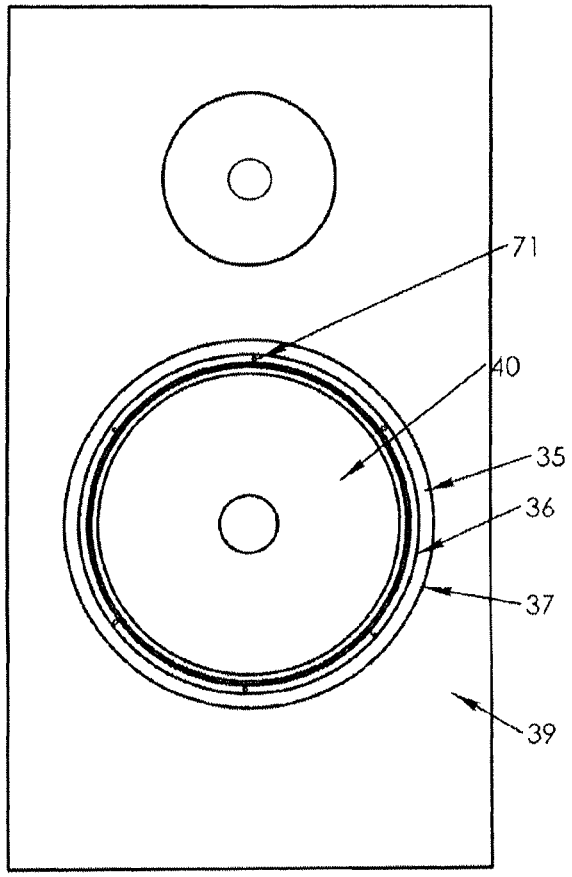
FIG. 10 is a zoomed out front view of a corresponding front panel with same preferred woofer and mount.

Reference is now made to FIG. 9 and FIG. 10. Circular acetal or ABS woofer driver mounts 35, 38 were designed and fabricated as illustrated with a partial cross section and simplified front view in FIGS. 9 and 10 to create a gradual slope 35 from the perimeter edge 36 of the driver 40 to the front surface 37 of the laminated glass panel 39, hence reducing the initial diffraction as the sound waves travel across the transducer perimeter.

The woofer is screwed 71 to the front of the customised non-resonant acetal or ABS mounting ring 35 & 38, a partial cross section and a simplified front view of which is illustrated in FIGS. 9 and 10. This mount is introduced from the front into the prepared hole of appropriate diameter which has been cut into the laminated glass front panel 39, and then bonded to the laminated glass front panel with a layer of vibrational energy absorbing semi-flexible adhesive sealant or tape where the two surfaces, that is the non-resonant acetal or ABS mounting ring 38 and the laminated glass 39, meet 51 around the mounting ring perimeter circumference, a circular overlapping surface approximately 1-1.5 cm in width. This bonding provides a degree of decoupling with regards to vibrational energy emanating from the woofer basket frame 40*a*.

Figure 11:
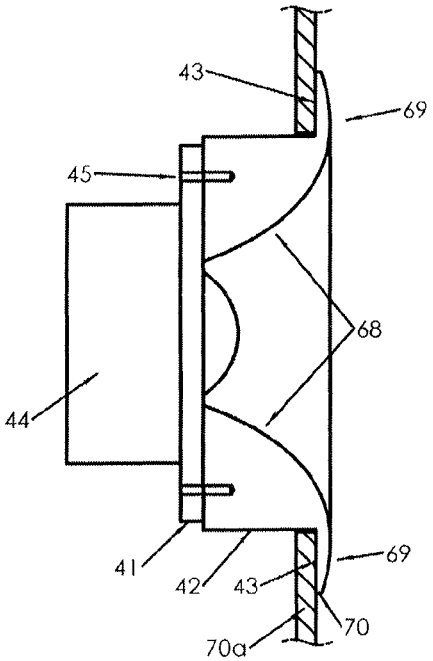
FIG. 11 is a cross section close up side view of a preferred tweeter transducer waveguide mount.

Reference is now made to FIG. 11. The tweeter transducer in FIG. 11 is fastened to a waveguide mount 42 specifically designed with sloping edges down to approximately half a millimeter at its outer circumference 70, again importantly reducing the initial diffraction as the sound waves travel out over the surface of the waveguide and then smoothly down the sloping acetal or ABS mount perimeter to the surface of the front laminated glass panel.

The tweeter 44, 41 is screwed 45 to the underside of a customised non-resonant plastic acetal or ABS waveguide 42 as shown in a close up cross section in FIG. 11. The waveguide holding the tweeter is introduced from the front into the prepared hole of appropriate diameter which has been cut into the laminated glass front panel and then bonded to the laminated glass front panel with a layer of adhesive sealant or tape where the two surfaces, the non-resonant engineering plastic waveguide and the laminated glass meet 43 around the perimeter of the waveguide, a circular overlapping surface approximately 1-1.5 cm in width. This bonding provides a degree of decoupling with regards to vibrational energy emanating from the tweeter face plate.

The waveguide shape 68 follows the design principles known in the art of loudspeakers as illustrated in a cross section in FIG. 11 and need not be described in detail here. The front surface of the waveguide is shaped to minimise diffraction of sound waves as they propagate outward from the centre to the circumference as they move across the outer edge of the waveguide 69 which is tapered down to about half a millimeter 70 becoming almost flush with the front panel of the enclosure that it is bonded to 70*a*.

The preferred non-resonant engineering plastic material of which the tweeter waveguide mounts and woofer tapered ring mounts are made is solid black acetal or ABS.

Figure 12:
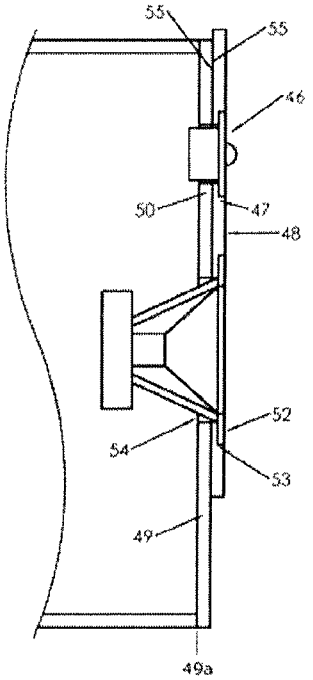
FIG. 12 is a partial cross section side view of a laminated glass loudspeaker enclosure with additional partial front panel showing driver mounting arrangements.

Reference is now made to FIG. 12 which shows an alternate embodiment design which utilises a partial front panel of laminated acrylic 48 that is appropriately rebated to enable flush fastening of transducers, which is then bonded to the front surface of the laminated glass panel 49. The preferred engineering plastic for this partial front panel of laminated acrylic is solid black acrylic sheet of approximately 3-10 mm thickness adhered to a second sheet of solid black acrylic sheet of unequal thickness approximately 10-20 mm thickness. These two acrylic sheets of unequal thickness being laminated with an industrial double-sided adhesive sheet interlay of approximately half a millimeter thickness.

The tweeter 46 sits in a prepared rebated hole 47 of appropriate diameter and depth, in a partial front panel 48 made of laminated acrylic that has been cut and polished with arrised edges, and fastened with screws so that the front surface of the tweeter face plate and the front surface of the partial panel are flush with each other. This partial panel is then bonded with a vibrational energy absorbing semi-flexible adhesive sealant or tape to a complete laminated glass front panel 49 of the loudspeaker enclosure which has a prepared hole 50 cut into it so that the two prepared tweeter holes 47 & 50 align, as illustrated in a cross section in FIG. 12. This provides for a layer of vibrational energy absorbing and decoupling adhesive sealant material between the partial panel of laminated acetal and the laminated glass front panel. The complete laminated glass front panel is bonded to the front or forward facing edges of the top, bottom and side panels of the loudspeaker enclosure with vibrational energy absorbing semi-flexible adhesive sealant or tape 49*a*. This provides a further layer of vibrational energy absorbing and decoupling adhesive sealant material between the front laminated glass panel and the remaining panels of the loudspeaker enclosure 49*a*.

The woofer sits in a prepared rebated hole 53 of appropriate diameter and depth in a partial front panel 48 as shown in FIG. 12 made of laminated acrylic and fastened with screws, so that the front perimeter surface of the woofer frame 52 and the front surface of the partial panel 48 are flush with each other. This partial panel 48 is then bonded with a vibrational energy absorbing semi-flexible adhesive sealant or tape 55 to the complete laminated glass front panel 49 of the loudspeaker enclosure which also has a prepared hole 54 cut into it so that the two prepared woofer insertion holes align, as illustrated in a cross section in FIG. 12. This provides a layer of vibrational energy absorbing and decoupling material between the partial panel of laminated acetal and the laminated glass front panel. The complete laminated glass front panel is bonded to the front facing edges of the top, bottom and side panels of the loudspeaker enclosure with vibrational energy absorbing semi-flexible adhesive sealant or tape 49*a*. This provides a further layer of vibrational energy absorbing and decoupling adhesive sealant material between the front laminated glass panel and the remaining panels of the loudspeaker enclosure 49*a*.

Figure 13:
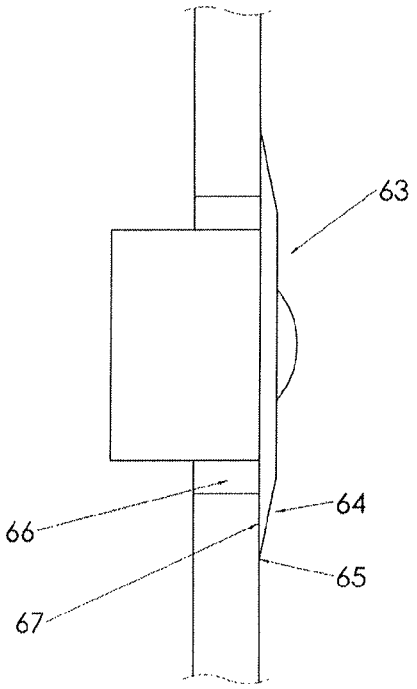
FIG. 13 is a close up cross section side view of a tweeter transducer with a modified face plate for a preferred mounting embodiment.

Referring to FIG. 13, there is provided another preferred embodiment, wherein the tweeter transducer has been modified to include a tapered edge at its perimeter. The tweeter has a customised faceplate 63 made of a metal-alloy or a non-resonant engineering plastic without perimeter fastening holes and of a somewhat larger perimeter than that of the original face plate, that gradually slopes and tapers 64 down to approximately half a millimeter in thickness at its perimeter circumference 65 as shown in FIG. 13. This faceplate is bonded directly to the laminated glass front panel 67 through a prepared hole 66 of the appropriate diameter using a semi-flexible vibrational energy absorbing and decoupling adhesive sealant or tape, preferably with a circular overlapping surface between the front panel laminated glass and tweeter face plate 67 of approximately 1-1.5 cm in width.

Figure 14:
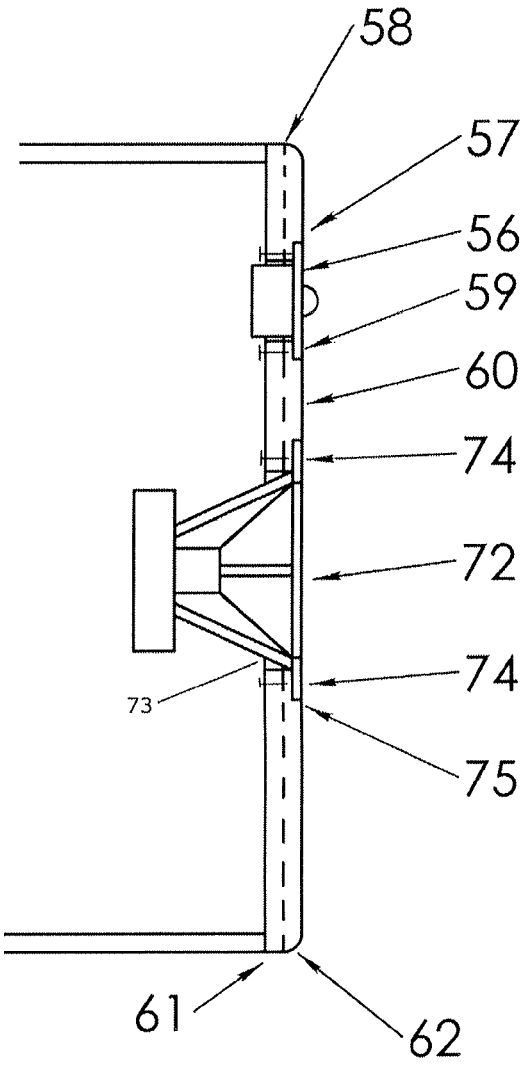
FIG. 14 is a partial cross section side view of a laminated glass loudspeaker enclosure showing a front panel of laminated acrylic with driver mounting arrangements.

Referring to FIG. 14, there is provided other embodiments which have the whole front panel made of laminated acrylic for enabling appropriate rebating for the fastening of transducers. The preferred engineering plastic front panel embodiment option utilises solid black acrylic sheet of approximately 3-10 mm thickness adhered to a second sheet of solid black acrylic sheet of approximately 10-20 mm thickness. These two acrylic sheets of unequal thickness are laminated using an industrial double-sided adhesive sheet interlay 58 of approximately half a millimeter thickness as shown in FIG. 14.

The tweeter face plate 56 sits in a rebated hole 57 of appropriate diameter and depth in a front baffle 60 made of non-resonant laminated 58 acrylic sheet and is fastened with screws 59 so that the surface of the face plate 56 and the surface of the baffle 60 are flush with each other as shown in FIG. 14.

The woofer 72 sits in a rebated hole 73 of appropriate diameter and depth in a front panel 60 made of non-resonant laminated acrylic sheet and fastened with a plurality of screws 74 so that the front perimeter surface of the woofer frame and the surface of the panel are flush with each other 75 as shown in FIG. 14.

The front baffle 60 which has been cut and polished with arris 62 to the appropriate size is bonded 61 with an energy absorbing semi-flexible adhesive sealant or tape to the forward or front edges of the top, bottom and side panels of the loudspeaker enclosure.

Figure 15:
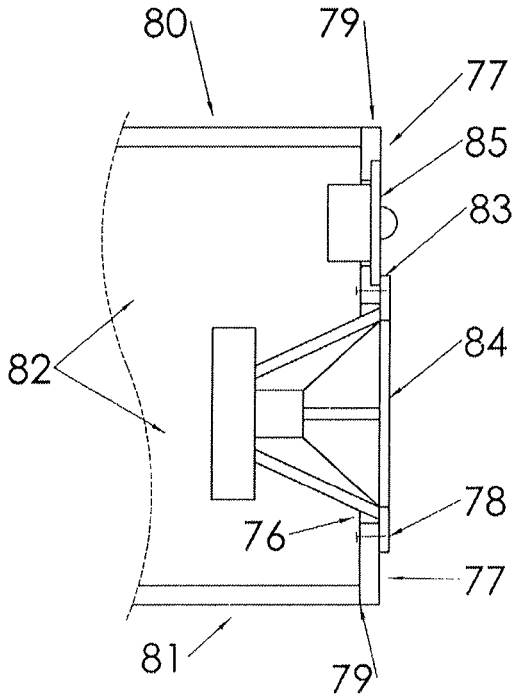
FIG. 15 is a partial cross section side view of a laminated glass loudspeaker enclosure with proud mounting of woofer.

Reference is now made to FIG. 15. The woofer sits in and over a hole 76 of appropriate diameter in a front panel 77 made of laminated acrylic, and fastened with screws 78 around its perimeter as illustrated in a cross sectional view in FIG. 15. The front panel 77 which has been cut and polished with arrised edges to the appropriate size is bonded with an energy absorbing and decoupling semi-flexible adhesive sealant or tape 79 to the forward or front facing edges of the top 80, bottom 81 and side panels 82 of the loudspeaker enclosure. This arrangement of woofer transducer mounting is acoustically acceptable where there would otherwise be insufficient height in the front panel for the tweeter and woofer to fit and/or when it is required in the loudspeaker design that there is the minimum possible distance between the 'acoustic centres' of the tweeter and woofer, to minimise lobing, and therefore a small amount of physical overlap 83 of the woofer 84 and tweeter 85 is implemented, however the tweeter must be flush mounted 77, 85 to minimise diffraction in this embodiment.

The embodiment of this invention for a Centre Speaker FIG. 16, 89 typically positioned above or below a TV, Video screen or monitor follows the same material and construction details as described above except that it will typically have either one central tweeter, sometimes with the addition of one central midrange driver, and two lateral woofers in a horizontal arrangement, or one central woofer 87 and two lateral tweeters 88 in a horizontal arrangement.

Figure 16:
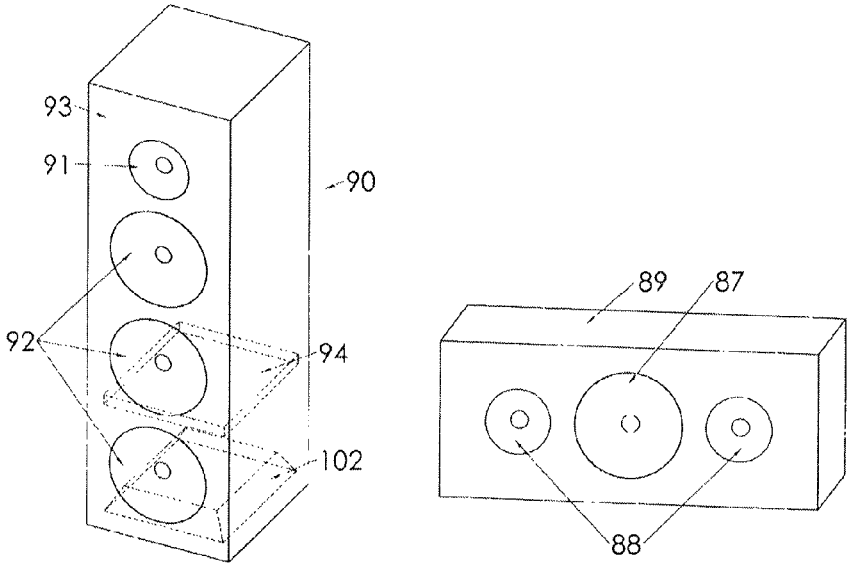
FIG. 16 is a simplified perspective view of a floorstanding laminated glass loudspeaker and a centre laminated glass loudspeaker in preferred embodiment options.

The embodiment of this invention for a Floorstanding Speaker 90 follows the same material and construction details as described above except that it will typically have one tweeter 91 at or near the top of the front panel of the enclosure, or just below a midrange driver positioned near the top of the enclosure, and between one and four woofers 92 of similar or different diameters vertically arranged below the tweeter on the front panel 93 of the enclosure as shown in FIG. 16. There is also sometimes one or more bass or sub woofers mounted towards the bottom of the front, side or sides of the floorstanding loudspeaker enclosure. In a variation of this embodiment internal clear laminated glass division(s) 94 are bonded with an airtight seal to all the adjoining internal surfaces of the panels of the enclosure, positioned in a horizontal or near horizontal orientation to create a separate air cavity for specific woofer or bass woofer driver(s) according to the design requirements.

Figure 17:
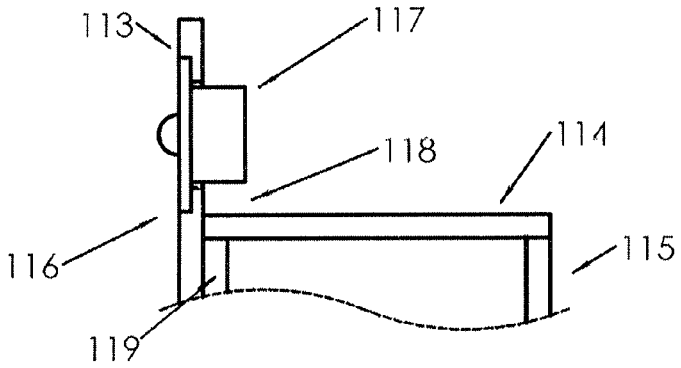
FIG. 17 is a partial cross section view of a floorstanding laminated glass loudspeaker with a freestanding tweeter transducer above the top of the enclosure.

In another preferred embodiment of a floorstanding laminated glass loudspeaker as shown in FIG. 17 a partial front panel 113 of laminated acrylic sheet extends vertically above the top panel 114 of the laminated glass loudspeaker enclosure 115 sufficiently for a tweeter transducer to be flush mounted 116 in an appropriately rebated hole in said vertical partial front panel with the whole of the tweeter transducer rear body being in free air 117 and outside of the said loudspeaker enclosure, sitting approximately a few millimeters to a few centimeters above the top surface of the top glass panel 118 of the floorstanding loudspeaker enclosure. This partial laminated acrylic front panel is bonded to the complete laminated glass front panel 119 of the floorstanding loudspeaker enclosure.

The embodiment of this invention in Subwoofer Speakers follows the same material and construction details as described above for bookshelf speakers, except that this arrangement does not include tweeters and will typically have not more or less than three or four panels of laminated glass with the other two or three panels consisting of laminated acrylic.

The embodiment of these laminated glass and laminated acrylic loudspeaker enclosures includes a system of damping internal sound waves and reflections so as to minimise the build up of internal standing waves or modes. This is achieved by internally placing open cell polyurethane foam sheets that are similar to the internal dimensions of the adjacent panel, that will absorb sound pressure waves present in the internal air column. To minimise modes in all directions sound waves need to be damped in the three dimensions, which can be described as height, width and depth. These foam sheet baffles consist of open cell polyurethane foam preferably rated with a density of between 25-35 kg/m$^3$ and a hardness of between 200-400 Newtons, with a thickness of between 1-4 cm's, preferably in dark grey or black to complement the aesthetic of the preferred loudspeaker embodiments. The foam panels are perforated to assist with diffusion. Preferred perforation characteristics are holes of diameters between 5-25 mm with a total surface area totalling between 20-45% of the said foam baffle. Foam within these parameters is able to successfully achieve five important functions: 1. It is of sufficient structural integrity to support itself and therefore does not need to be otherwise supported or braced. 2. It absorbs sound pressure waves, avoiding being either too porous to them with minimal absorption or too reflective of them again with minimal absorption. 3. When placed at oblique angles in relation to enclosure panels it absorbs, disrupts and diffuses the movement of these sound pressure waves in the air column so as to avoid the undesirable effects of a perfect rectangular cube having three pairs of parallel sides. The presence of these foam panels creates the effect to varying degrees of acoustically apparent non-parallel sides in the enclosure which reduces the development and maintenance of standing waves or modes. 4. It provides a method of damping in three dimensions without obscuring vision unnecessarily. 5. It provides an interesting and complementary internal aesthetic.

Figure 18:
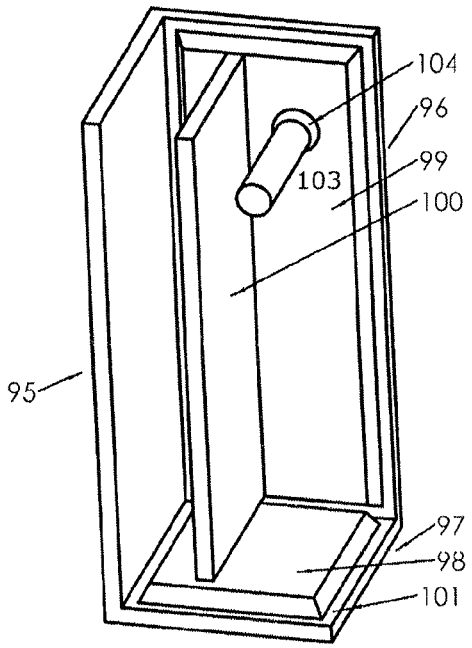
FIG. 18 is a simplified perspective view of a partial laminated glass loudspeaker enclosure internal space with a preferred embodiment of foam baffles in place.

These foam baffles can be positioned in a plurality of configurations, one preferred embodiment of which is shown in FIG. 18 which is a view from above and in front of an enclosure with the top panel, front panel & drivers, side panel and crossover removed for simplification and easier depiction of the inner foam baffle sheets, leaving just side 95, rear 96 and bottom 97 panels visible in the diagram. In keeping with the five required functions of the internal foam baffles as described above, they are placed on the bottom or floor 98 of the internal enclosure in all preferred embodiments, providing damping of waves moving in the height dimension without affecting internal viewing through the front, sides or top of the laminated glass enclosure. Foam is placed against or near and parallel to the rear 99 panel of the internal enclosure, providing damping of waves moving in the depth dimension, again without affecting internal viewing through the front, sides or top of the enclosure. An embodiment of a rear reflex port 103 is also shown which simply requires a hole 104 of appropriate size to be cut in the foam and enclosure rear panel. To provide damping of waves in the width dimension a foam panel is placed between the two side panels. This foam panel can be one piece 100 which reaches back almost to the rear panel and forwards almost to the front panel, or it can be split into two pieces which together cover the depth dimension between the front and rear enclosure panels, with or without overlap.

Figure 19:
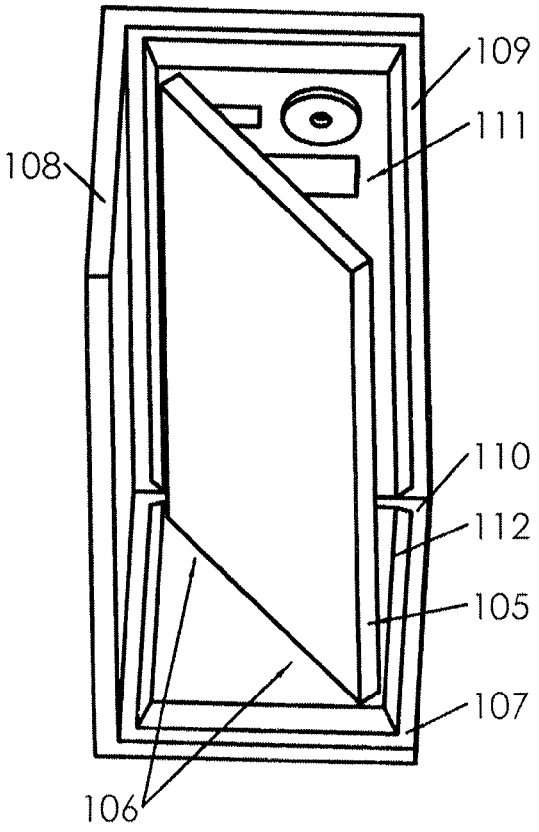
FIG. 19 is a simplified perspective view of a partial laminated glass loudspeaker enclosure internal space with another preferred embodiment of foam baffles in place.

Illustrated in FIG. 19 is a view from above and in front of an enclosure with the top panel, front panel & drivers and side panel removed for simplification and easier depiction of the inner foam baffles, leaving just side 108, rear 109 and bottom 110 panels and a preferred embodiment rear upright crossover network board 111 with the electronic components depicted and on show, in the diagram. One foam baffle 112 is glued to the bottom of the enclosure. By placing another foam baffle 105 upright and on an oblique angle from near a rear enclosure corner to near a front enclosure corner it provides wave absorption and disruption in both the width and depth dimensions.

The foam baffles are held in place by gluing them to the internal base 110 or rear panel of the loudspeaker enclosure or to each other 106. For aesthetic and viewing purposes they are not glued to the front, top or side panels of the enclosure. For aesthetic and viewing purposes they are not pushed up directly against or in contact with the front, top or side panels of the enclosure. To enhance the internal aesthetic and allow sufficient internal air flow, particularly for bass reflex designs, all internal foam baffle configurations are positioned to maintain a space between their outer perimeters and the neighbouring enclosure panels 95 & 108 of approximately 0.5-2 cm's.

In floorstanding embodiments a significantly thicker piece of foam would be used to cover the internal base or floor of the enclosure 102 in order to dampen the significant sound pressure waves that can develop in the height dimension of a floorstanding loudspeaker enclosure. In subwoofers no foam is required due to the wavelength of the selectively generated bass frequencies being longer than any internal dimension of the enclosure.

The embodiment of these laminated glass and laminated acrylic loudspeaker enclosures includes a system of further disrupting and diffusing internal sound waves and reflections so as to minimise the build up of internal standing waves or modes. This is achieved by placing panels of between 2-4.5 mm thickness of clear acrylic sheets that are perforated with a plurality of holes of between 5-35 mm in diameter comprising a total of approximately 20-55% of the surface area of said panels. These perforated panels are similar in dimension and typically sit adjacent and parallel to existing internal foam baffles. These acrylic baffle panels have a greater disrupting effect as compared to the foam baffles described above. Together, with the perforated foam baffles having an absorbing and damping effect and the perforated acrylic baffle panels having a diffusing and disrupting effect, they complement and combine with each other to provide an effective internal sound wave damping, absorbing, diffusing and reflection disrupting effect, which reduces the amount and strength of sound waves impacting on the rear surface of the housed woofer cone(s), resulting in reduced distortion and colouration in the loudspeaker sonic output, and therefore increased acoustic fidelity.

The embodiment of these laminated glass and laminated acrylic loudspeaker enclosures includes a system of further diffusing and disrupting internal standing waves. This is achieved by the use of not more than a total of three clear acrylic plastic hollow spheres, half spheres, cylinders or half cylinders having a thickness of between 2-4 mm, with dimensions not less than 30% of the smallest internal dimension of the enclosure and not more than 90% of the largest internal dimension of the enclosure, and bonded in place. These are perforated with a plurality of holes of between 5-35 mm in diameter comprising a total of approximately 20-55% of the surface area of said baffle objects. These clear curved surfaces while not obscuring views of the internal space of the enclosure provide excellent disruption and diffusion of internal sound waves into a plurality and variety of reflected angles reducing internal standing waves or modes.

The embodiment of these laminated glass and laminated acrylic loudspeaker enclosures includes an internal light source such that the internal light source is visible through the laminated glass panels.

The embodiment of these high fidelity high performance loudspeakers includes but is not limited to bass reflex, sealed box, aperiodic or dipole designs.

In the unlikely event of a severe blow to the loudspeaker enclosure or a fall from a height onto a hard surface, with the use of laminated glass, one or more panels may chip or crack, however they are very unlikely to shatter or collapse due to the interlay material maintaining the integrity of each panel; for example, where the laminated front windscreen of a motor vehicle may be cracked during a significant collision however stays in place. If one or more panels should ever crack or chip they can be replaced, restoring an as new appearance and airtight joint integrity. Toughened glass is not used in any of the embodiments of this invention not only because it has a tendency to 'ring' in response to vibrational excitation, but also because toughened glass, if struck with sufficient force, will shatter completely into a myriad of tiny cubes which could result in the structural failure or total collapse of an enclosure.

It will be appreciated that the present invention is not limited to the embodiments and their exact construction methods as described above and illustrated in the accompanying drawings, and that variations and modifications can be made with the attainment of some or all of the advantages of the invention without departing from the scope and spirit thereof. Therefore it is the object of the appended claims to cover all such variations and modifications as come within the true spirit and scope of the invention.

The invention claimed is:

1. A loudspeaker enclosure comprising a plurality of panels bonded together to form an enclosure for housing at least one electro-mechanical acoustic transducer, wherein at least one of the panels comprises substantially laminated glass and at least another one of the panels comprises substantially laminated acrylic; further comprising a laminated glass-panel having an aperture for receiving a woofer transducer unit, wherein the woofer transducer unit is connected to the laminated glass panel by a mounting ring, the mounting ring is bonded to the laminated glass panel by semi-flexible vibrational absorbing adhesive material and the mounting ring of the woofer transducer unit comprises a perimeter edge tapering down outwardly to partially covers front surface of the laminated glass panel.

2. A loudspeaker enclosure in accordance with claim 1, wherein one of the plurality of panels is a front panel, said front panel comprises substantially laminated glass.

3. A loudspeaker enclosure in accordance with claim 2, wherein the front panel is partially covered by a laminated acrylic front panel.

4. A loudspeaker enclosure in accordance with claim 1, wherein one of the plurality of panels is a front panel, said front panel comprises substantially laminated acrylic.

5. A loudspeaker enclosure in accordance with claim 1, wherein the at least one panel with the greatest surface area comprises substantially laminated glass.

6. A loudspeaker enclosure in accordance with claim 1, wherein at least the top panel and two side panels comprise substantially laminated glass.

7. A loudspeaker enclosure in accordance with claim 1, wherein each of the panels comprises arris edges.

8. A loudspeaker enclosure in accordance with claim 1, wherein at least one panel is bonded with another panel using semi-flexible vibrational energy absorbing adhesive material.

9. A loudspeaker enclosure in accordance with claim 8, wherein the semi-flexible vibrational energy absorbing adhesive material comprises silicone or acrylic adhesive.

10. A loudspeaker enclosure in accordance with claim 1, wherein the panels form a substantially cube-like or rectangular cube-like enclosure.

11. A loudspeaker enclosure in accordance with claim 1, wherein the mounting ring comprises substantially a non-resonant engineering, plastic material, such as acetal or ABS/acrylonitrile butadiene styrene.

12. A loudspeaker enclosure in accordance with claim 11, wherein the woofer transducer unit comprises a mounting ring made of engineering plastic and a woofer transducer, wherein the mounting ring fits into the aperture on the laminated glass panel.

13. A loudspeaker enclosure in accordance with claim 11, wherein the mounting ring comprises a tapering circumferential fringe sitting on the front surface of the laminated glass panel and the woofer transducer unit has an outer edge, such that the outer edge of the woofer transducer unit and the tapering circumferential fringe form a gradual slope to the front surface of the laminated glass panel to form the perimeter edge of the woofer transducer unit.

14. A loudspeaker enclosure in accordance with claim 1, further comprising a tweeter unit, wherein the tweeter unit comprises a tweeter transducer connected to a waveguide which fits into the aperture of the laminated glass panel, wherein the waveguide comprises an outer, edge extending outwardly from the tweeter transducer over the front surface of the laminate glass panel, such that the outer edge of the waveguide tapers down to cover partially a front surface of the laminated glass panel with a gradually sloping surface.

15. A loudspeaker enclosure in accordance with claim 14, wherein the waveguide and laminated glass panel are connected together by semi-flexible vibrational absorbing adhesive material.

16. A loudspeaker enclosure in accordance with claim 14, wherein the waveguide comprising substantially of a non-resonant dense engineering plastic material, such as acetal or ABS.

17. A loudspeaker enclosure in accordance with claim 1, further comprising a laminated glass panel having an aperture for receiving a tweeter transducer unit comprising a modified face plate which covers the said aperture and is bonded to the laminated glass panel with semi-flexible vibrational absorbing adhesive material.

18. A loudspeaker enclosure in accordance with claim 17 modified face plate being substantially of engineering plastic or metal alloy material and having a perimeter edge tapering down outwardly to a surface of the laminated glass.

19. A loudspeaker enclosure in accordance with claim 1, comprising a laminated acrylic partial front panel bonded on top of a laminated glass front panel with semi-flexible vibrational energy absorbing adhesive material, wherein the laminated acrylic partial front panel and the laminated glass front panel, each of which has an aperture coincided with one another for receiving at least one tweeter and at least one woofer transducers, such that a front surface of the tweeter (s) and woofer (s) transducers and a front surface of the acrylic front partial panel are flush with one another to form a coplanar surface.

20. A loudspeaker enclosure in accordance with claim 4, comprising a laminated acrylic front panel bonded to the front facing edges of the top, bottom and side panels, wherein there is at least one rebated aperture of suitable dimensions, and at least one transducer is flush mounted therein.

21. A loudspeaker enclosure in accordance with claim 1, further comprising at least two sound wave absorbing foam sheets disposed inside of the loudspeaker enclosure with at least one of the foam sheets positioned obliquely across two of the three internal dimensions and another across the remaining dimension of the internal enclosure space, wherein each foam sheet is perforated with a plurality of holes of between 5-25 mm diameter covering a total of approximately 20-45% of the surface area of the panels.

22. A loudspeaker enclosure in accordance with claim 21, wherein each foam sheet has a density between 25-35 kg/m$^3$, a hardness between 200-400 Newtons, and a thickness between 1-4 cm.

23. A loudspeaker enclosure in accordance with claim 1, further comprising a sound wave disrupter and diffuser fixed internally in the loudspeaker enclosure, wherein the sound wave disrupter and diffuser comprises at least one perforated clear acrylic panel or cylinder or half-cylinder or hollow sphere or hollow half-sphere with a thickness of 2-4.5 millimeters, which comprises dimensions not less than 30% of the smallest internal dimension and not more than 90% of the largest internal dimension of the loudspeaker enclosure, with at least one perforated clear acrylic panel or hollow tube or hollow sphere or hollow half sphere are perforated with a plurality of holes of between 5-35 mm diameter comprising a total of approximately 20-55% of their surface area.

24. A loudspeaker enclosure in accordance with claim 23, wherein the foam sheet and acrylic panel or hollow tube or hollow sphere as described are not perforated.

25. A loudspeaker enclosure in accordance with claim 1, wherein the thickness of one or more panels of laminated glass is between 6-18 millimeters.

26. A loudspeaker enclosure in accordance with claim 1, wherein the thickness of the at least one panel of laminated acrylic comprises of one acrylic panel of between 3-10 millimeters laminated to another acrylic panel of between 10-20 millimeters.

27. A loudspeaker enclosure in accordance with claim 1, wherein each laminated acrylic panel is being of two or more acrylic sheets of unequal thickness laminated to each other.

28. A loudspeaker enclosure in accordance with claim 1, wherein the thickness of the at least one panel of laminated glass comprises of one glass lite of between 3-8 millimeters laminated to another glass lite of between 3-8 millimeters.

29. A loudspeaker enclosure in accordance with claim 1, wherein the thickness of the at least one panel of laminated glass comprises of glass lites of unequal thickness to each other.

30. A loudspeaker enclosure in accordance with claim 1, wherein the at least one panel of laminated glass is of a curved shape.

31. A loudspeaker enclosure in accordance with claim 1, wherein the thickness of the laminated glass interlay is between 0.3-0.9 millimeters.

32. A loudspeaker enclosure in accordance with claim 1, wherein the laminated glass interlay comprises EVA.

33. A loudspeaker enclosure in accordance with claim 1, wherein the thickness of the double sided self-adhesive interlayer of one or more panels of laminated acrylic is between 0.3-0.7 millimeters.

34. A loudspeaker enclosure in accordance with claim 1, further comprising an internal light source such that the internal light source is visible through the laminated glass panel.

35. A loudspeaker enclosure in accordance with claim 1, wherein the enclosure houses at least one tweeter transducer and one woofer transducer.

36. A loudspeaker enclosure in accordance with claim 21, wherein the foam sheet and acrylic panel or hollow tube or hollow sphere as described are not perforated.

37. A loudspeaker enclosure in accordance with claim 22, wherein the foam sheet and acrylic panel or hollow tube or hollow sphere as described are not perforated.

* * * * *